US010130962B2

(12) United States Patent
Dey et al.

(10) Patent No.: US 10,130,962 B2
(45) Date of Patent: Nov. 20, 2018

(54) WIRELESSLY CONTROLLED TRIGGER START AND CHEMICAL TANK CHANGE-OVER FOR PRESSURE WASHERS

(71) Applicant: Briggs & Stratton Corporation, Wauwatosa, WI (US)

(72) Inventors: John Dey, Milwaukee, WI (US); Brandon Palicki, Fort Atkinson, WI (US); James Radwill, Racine, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 442 days.

(21) Appl. No.: 14/051,325

(22) Filed: Oct. 10, 2013

(65) Prior Publication Data

US 2015/0102121 A1 Apr. 16, 2015

(51) Int. Cl.
*B05B 7/32* (2006.01)
*B05B 9/01* (2006.01)
(Continued)

(52) U.S. Cl.
CPC ..... *B05B 9/007* (2013.01); *B05B 7/32* (2013.01); *B05B 9/01* (2013.01); *B05B 12/002* (2013.01);
(Continued)

(58) Field of Classification Search
CPC ..... B05B 12/02; B05B 12/14; B05B 12/1418; B05B 7/2464; B05B 7/2472;
(Continued)

(56) References Cited

U.S. PATENT DOCUMENTS 408,907 A 8/1889 Woodbury et al.
828,705 A 8/1906 Bode
(Continued)

FOREIGN PATENT DOCUMENTS

DE 38 40 787 A1 6/1990
DE 299 08 357 U1 8/2000
(Continued)

OTHER PUBLICATIONS

U.S. Appl. No. 13/913,326, filed Jun. 7, 2013, Funke et al.
(Continued)

*Primary Examiner* — Chistopher Kim
*Assistant Examiner* — Joseph A Greenlund
(74) *Attorney, Agent, or Firm* — Foley & Lardner LLP

(57) ABSTRACT

A pressure washer includes a prime mover, a pump driven by the prime mover, and a spray gun fluidly coupled to the pump. The spray gun includes a flow-control valve movable between an open position and a closed position to control a fluid flow from the spray gun, a user interface for controlling the flow-control valve, a sensor configured to detect the state of the user interface, and a first wireless system electrically coupled to the sensor. In a first state of the user interface, the flow-control valve is in the closed position. In a second state of the user interface, the flow-control valve is in the open position. The pressure washer further includes a second wireless system electrically coupled to the prime mover. The second wireless system signals the prime mover to start to drive the pump to provide fluid to the spray gun upon receiving a start signal from the first wireless system indicating that the sensor detects the user interface in the second state.

15 Claims, 5 Drawing Sheets

(51) Int. Cl.

| | |
|---|---|
| ***B05B 3/02*** | (2006.01) |
| ***B05B 12/08*** | (2006.01) |
| ***B05B 12/14*** | (2006.01) |
| ***B05B 9/00*** | (2006.01) |
| ***B05B 12/00*** | (2018.01) |
| ***B08B 3/02*** | (2006.01) |
| ***B08B 3/08*** | (2006.01) |
| *B05B 7/24* | (2006.01) |
| *B05B 7/04* | (2006.01) |
| *B05B 9/04* | (2006.01) |

(52) U.S. Cl.

CPC ..... *B05B 12/004* (2013.01); *B05B 12/08* (2013.01); *B08B 3/02* (2013.01); *B08B 3/026* (2013.01); *B08B 3/08* (2013.01); *B05B 7/0408* (2013.01); *B05B 7/2497* (2013.01); *B05B 9/0409* (2013.01); *B05B 9/0413* (2013.01); *B05B 12/14* (2013.01); *B08B 2203/0217* (2013.01)

(58) Field of Classification Search

CPC ... B05B 7/0408; B05B 7/2497; B05B 12/002; B05B 9/01; B05B 9/007; B05B 9/0409; B05B 9/0413; B05B 7/32; B05B 12/004; B05B 12/08; B08B 2203/0217; B08B 2203/0241; B08B 3/026; B08B 3/028; B08B 3/02

USPC ..... 239/1, 69, 525–528, 444, 71, 73, 74, 239/303–305, 307, 310, 318, 335, 407, 239/413–415, 416.1, 417.5, 419, 422, 239/428, 433, 434, 574, 578, 579, 588

See application file for complete search history.

(56) References Cited

U.S. PATENT DOCUMENTS 1,262,539 A 4/1918 Micka
1,369,567 A 2/1921 Smith
2,540,240 A 2/1951 Boyle
2,678,457 A 5/1954 Demi et al.
3,030,890 A 4/1962 Galik
3,114,164 A 12/1963 Riordan
3,283,352 A 11/1966 Hu
3,383,044 A 5/1968 Norstrud et al.
3,748,678 A 7/1973 Ballou
3,786,869 A 1/1974 McLoughlin
3,888,325 A 6/1975 Reinbeck
3,931,830 A 1/1976 Gritz
4,084,281 A 4/1978 Smith
4,135,860 A 1/1979 Van Nederkassel
4,207,640 A 6/1980 Sekula et al.
4,227,862 A 10/1980 Andrew et al.
4,238,074 A 12/1980 Coons
4,249,282 A 2/1981 Little
4,290,735 A 9/1981 Sulko
4,373,444 A 2/1983 Cunnington
4,387,850 A 6/1983 Gerber
4,417,826 A 11/1983 Floros
4,461,052 A 7/1984 Mostul
4,507,053 A 3/1985 Frizzell
4,513,466 A 4/1985 Keddie et al.
4,532,666 A 8/1985 Smyth
4,585,168 A * 4/1986 Even ..... B08B 3/026 137/115.25
4,618,100 A 10/1986 White et al.
4,621,770 A 11/1986 Sayen
4,763,373 A 8/1988 Sanchez
4,856,133 A 8/1989 Sanchez
4,870,811 A 10/1989 Steele
4,882,896 A 11/1989 Wilcox
5,007,127 A 4/1991 Paolo
5,029,758 A 7/1991 Chayer
5,042,439 A 8/1991 Tholl et al.
5,085,043 A 2/1992 Hess et al.
5,129,121 A 7/1992 Gelman
5,186,142 A 2/1993 Brunelli et al.
5,208,525 A 5/1993 Lopic et al.
5,259,733 A 11/1993 Gigliotti et al.
5,381,962 A * 1/1995 Teague ..... B05B 12/00 239/525
5,383,605 A * 1/1995 Teague ..... B05B 12/00 239/525
5,395,052 A 3/1995 Schneider et al.
5,406,778 A 4/1995 Lamb et al.
5,421,520 A 6/1995 Simonette et al.
5,442,901 A 8/1995 Niemela et al.
5,529,460 A 6/1996 Eihusen et al.
5,606,851 A 3/1997 Bruener et al.
5,619,766 A 4/1997 Zhadanov et al.
5,649,334 A 7/1997 Henriquez et al.
5,741,124 A 4/1998 Mazzucato et al.
5,784,868 A 7/1998 Wadzinski et al.
5,794,580 A 8/1998 Galletti
5,906,088 A 5/1999 Inui et al.
5,910,091 A 6/1999 Iida et al.
5,911,256 A 6/1999 Tsai
5,913,982 A 6/1999 Phillips
RE36,250 E 7/1999 Hess et al.
5,934,053 A 8/1999 Fillman et al.
5,937,623 A 8/1999 Wolf
5,975,423 A 11/1999 Rice et al.
6,021,539 A 2/2000 Zhadanov et al.
6,077,186 A 6/2000 Kojima et al.
6,078,015 A 6/2000 Martinez
6,160,373 A 12/2000 Dunn et al.
6,164,496 A 12/2000 Gregory
6,189,811 B1 2/2001 Rudy
6,220,005 B1 4/2001 Plamper et al.
6,230,678 B1 5/2001 Gracyalny et al.
6,260,529 B1 7/2001 Gracyalny et al.
6,263,852 B1 7/2001 Gracyalny et al.
6,311,663 B2 11/2001 Gracyalny et al.
6,325,036 B1 12/2001 Gracyalny et al.
6,386,169 B1 5/2002 Gracyalny et al.
6,404,078 B1 6/2002 Thomas et al.
6,464,052 B1 10/2002 Hsiao
6,523,334 B1 2/2003 Dettmann
6,561,481 B1 5/2003 Filonczuk
6,571,542 B1 6/2003 Fillman et al.
6,571,805 B2 6/2003 Hoenisch et al.
6,595,176 B2 7/2003 Poehlman et al.
6,615,787 B2 9/2003 Gracyalny
6,622,683 B2 9/2003 Gracyalny et al.
6,647,942 B2 11/2003 Poehlman et al.
6,666,008 B2 12/2003 Iida et al.
6,687,924 B2 2/2004 Wright et al.
6,688,855 B2 2/2004 Beckerman
6,751,936 B2 6/2004 Kucera et al.
6,758,030 B2 7/2004 Dettmann
6,826,895 B2 12/2004 Iida et al.
6,913,221 B2 7/2005 Moon et al.
6,915,541 B2 7/2005 Alexander
6,921,060 B2 7/2005 Weed, Jr.
7,007,446 B2 3/2006 Dettmann
7,017,603 B1 3/2006 Rosine et al.
7,080,953 B2 7/2006 Delaine, Jr.
7,083,120 B2 8/2006 Gilpatrick et al.
7,128,037 B2 10/2006 Tumback et al.
7,180,200 B2 2/2007 Walter et al.
7,217,053 B2 5/2007 Alexander et al.
7,222,644 B2 5/2007 Pianetto et al.
7,281,903 B2 10/2007 Reverberi et al.
7,309,928 B2 12/2007 Grant et al.
7,316,368 B2 1/2008 Moon et al.
7,434,642 B2 10/2008 Dettmann
7,472,842 B2 1/2009 Gilpatrick et al.
7,479,754 B2 1/2009 Lucas et al.
7,540,132 B2 6/2009 Shimada et al.
7,677,017 B2 3/2010 Holby
7,687,926 B2 3/2010 Grant et al.
7,728,534 B2 6/2010 Lucas et al.

(56) References Cited

U.S. PATENT DOCUMENTS

| | | | | |
|---|---|---|---|---|
| 7,762,787 | B2 | 7/2010 | Kawakami et al. | |
| 7,782,626 | B2 | 8/2010 | Buck et al. | |
| 7,854,398 | B2 * | 12/2010 | Hahn | B08B 3/026 239/314 |
| 7,989,969 | B2 | 8/2011 | Grant et al. | |
| 8,271,141 | B2 * | 9/2012 | Cummings | F15B 19/005 137/55 |
| 8,425,203 | B2 | 4/2013 | Gardner et al. | |
| 8,485,796 | B2 | 7/2013 | Gilpatrick | |
| 2004/0012204 | A1 | 1/2004 | Walter et al. | |
| 2004/0231723 | A1 * | 11/2004 | Harrington et al. | 137/355.2 |
| 2005/0013708 | A1 | 1/2005 | Peeler et al. | |
| 2005/0017117 | A1 | 1/2005 | Moon et al. | |
| 2005/0161538 | A1 | 7/2005 | Cattaneo et al. | |
| 2005/0164554 | A1 | 7/2005 | Cattaneo et al. | |
| 2006/0027253 | A1 * | 2/2006 | Kaiser | 134/94.1 |
| 2006/0083634 | A1 | 4/2006 | Dexter et al. | |
| 2006/0245941 | A1 | 11/2006 | Sharp | |
| 2007/0113368 | A1 | 5/2007 | Alexander | |
| 2007/0114319 | A1 | 5/2007 | Anderson et al. | |
| 2007/0125878 | A1 * | 6/2007 | Hahn et al. | 239/332 |
| 2008/0014096 | A1 | 1/2008 | Gilpatrick | |
| 2008/0050246 | A1 | 2/2008 | Bevington | |
| 2008/0079264 | A1 | 4/2008 | Serdynski et al. | |
| 2008/0083077 | A1 | 4/2008 | Alexander et al. | |
| 2008/0120955 | A1 | 5/2008 | Lucas et al. | |
| 2008/0223012 | A1 | 9/2008 | Rosa et al. | |
| 2008/0245425 | A1 | 10/2008 | Alexander | |
| 2008/0289309 | A1 | 11/2008 | Gust et al. | |
| 2008/0300727 | A1 | 12/2008 | Zarowny et al. | |
| 2009/0064957 | A1 | 3/2009 | Grybush | |
| 2009/0223475 | A1 | 9/2009 | Wilson et al. | |
| 2009/0255502 | A1 | 10/2009 | Cook | |
| 2009/0269218 | A1 | 10/2009 | Gardner et al. | |
| 2009/0278509 | A1 | 11/2009 | Boyles et al. | |
| 2010/0243086 | A1 | 9/2010 | Gilpatrick | |
| 2011/0014066 | A1 | 1/2011 | Gilpatrick | |
| 2011/0073189 | A1 | 3/2011 | Elbert et al. | |
| 2012/0006431 | A1 | 1/2012 | Gilpatrick | |
| 2013/0092745 | A1 * | 4/2013 | Karp | B08B 3/026 239/1 |
| 2013/0111864 | A1 | 5/2013 | Hansen et al. | |
| 2013/0214059 | A1 * | 8/2013 | Gilpatrick | B08B 3/026 239/289 |

FOREIGN PATENT DOCUMENTS

| | | |
|---|---|---|
| EP | 2 332 768 | 6/2011 |
| JP | 2006-263628 | 10/2006 |

OTHER PUBLICATIONS

U.S. Appl. No. 13/918,701, filed Jun. 14, 2013, Gilpatrick.

"Powerboss Pressure Washer" Operator's Manual, copyright 2010, Briggs & Stratton Power Products Group, LLC, 26 pages.

"Ryobi TouchStart Straight Shaft String Trimmer", http://www.youtube.com/watch?feature=endscreen&NR=1&v=qgpCdihrss0, uploaded to YouTube Apr. 27, 2011, 1 page.

"Ryobi® TouchStart", http://www.youtube.com/watch?v=BpyOxL9IG88&noredirect=1, uploaded to YouTube Feb. 24, 2010, 1 page.

"How to Start Ryobi Touch Start™ Petrol Line Trimmer and Brush Cutter," http://www.youtube.com/watch?v=tjAtHunBemM&feature=related, uploaded to YouTube Dec. 9, 2011, 1 page.

Energy Tips-Pumping Systems, Pumping Systems Tip Sheet #12, Control Strategies for Centrifugal Pumps with Variable Flow Rate Requirements, U.S. Department of Energy, May 2007, 2 pages.

Garden Hose Centrifugal Pump I BIC Superstore, Flint Walling/Star HPP360 Garden Hose Centrifugal Pump, printed on Jan. 6, 2009, from Internet address: http://www.bicsuperstore.com/Garden-Hose-Centrifugal-Pump/M/B000DZKZ02.htm, 3 pages.

Garden Hose Comfort Grip Nozzle 7 Pattern #594 by Gilmour Manufacturing, http://www.hardwareandtools.com/invt/3774379, retrieved on Jan. 6, 2009, 4 pages.

Gauges, Water Pumps, and Flow Meters from Premium Water Filters, Premium Water Filters, printed on Jan. 6, 2009, from Internet address: http://www.premium-water-filters.com/gauges-pumps.htm, 12 pages.

International Search Report and Written Opinion for Application No. PCT/US2010/028157, dated Aug. 31, 2011, 23 pages.

International Search Report and Written Opinion regarding PCT/US2013/035623, dated Sep. 10, 2013, 19 pages.

Invitation to Pay Additional Fees and Partial International Search Report for International Application No. PCT/US2010/028157, dated Jun. 10, 2011, 10 pages.

Partial Search Report for International Application No. PCT/US2013/035623, dated Jul. 10, 2013, 2 pages.

Office Action for U.S. Appl. No. 13/918,071 dated Dec. 16, 2013, 12 pages.

U.S. Office Action, U.S. Appl. No. 13/918,701, 11 pages (dated Jun. 19, 2015).

U.S. Office Action, U.S. Appl. No. 13/913,326, 17 pages (dated Sep. 4, 2015).

U.S. Office Action, U.S. Appl. No. 14/223,850, 20 pages (dated May 27, 2015).

* cited by examiner

WIRELESSLY CONTROLLED TRIGGER START AND CHEMICAL TANK CHANGE-OVER FOR PRESSURE WASHERS

BACKGROUND

The present invention relates generally to the field of pressure washers. More specifically, the invention relates to a pressure washer system including a multiple chemical tanks and a control mechanism for switching the output of the spray system between the multiple chemical tanks.

The use of spray guns for cleaning and other tasks is well known. Spray guns can be used for a broad range of tasks, including for example cleaning cars, watering plants, washing home windows and siding, rinsing out a warehouse floor or garage, and the like. These spray guns typically attach to a water supply to provide a water spray of differing pressures, dependent upon the desired task. Pressure washers have been designed to accommodate liquid chemical bottles or containers at the base of the pressure washer, which typically includes a prime mover and a pump. The chemical container allows a liquid chemical to be introduced into a pressurized water stream provide by the pump to a spray gun. This liquid chemical may be a detergent for cleaning various surfaces, a fertilizer for lawn care, a pesticide, an herbicide, etc. In order to utilize a different chemical, the user must either dispose of any unused chemical within the container and refill the container with their chemical of choice, physically change out the container in use with a different container, or physically adjust an input (e.g. a valve) on the base of the pressure washer to switch between multiple chemical containers. That is, the user cannot easily switch chemicals for use with the spray gun.

SUMMARY

One embodiment of the invention relates to a pressure washer including a prime mover, a pump driven by the prime mover, and a spray gun fluidly coupled to the pump. The spray gun includes a flow-control valve movable between an open position and a closed position to control a fluid flow from the spray gun, a user interface for controlling the flow-control valve, a sensor configured to detect the state of the user interface, and a first wireless system electrically coupled to the sensor. In a first state of the user interface, the flow-control valve is in the closed position. In a second state of the user interface, the flow-control valve is in the open position. The pressure washer further includes a second wireless system electrically coupled to the prime mover. The second wireless system signals the prime mover to start to drive the pump to provide fluid to the spray gun upon receiving a start signal from the first wireless system indicating that the sensor detects the user interface in the second state.

Another embodiment relates to a pressure washer including a prime mover, a pump driven by the prime mover, and a spray gun fluidly coupled to the pump. The spray gun includes a first wireless system and a chemical user interface electrically coupled to the first wireless system. The chemical user interface is configured to select between a first chemical mode, a second chemical mode, and a no chemical mode. The pressure washer further includes a second wireless system, a first chemical container fluidly coupled to the spray gun and configured to contain a first chemical, a second chemical container fluidly coupled to the spray gun and configured to contain a second chemical, a first chemical control valve, and a second chemical control valve. The first chemical control valve is fluidly coupled between the first chemical container and the spray gun to control the flow of the first chemical to the spray gun. The first chemical control valve is electrically coupled to the second wireless system. The second chemical control valve is fluidly coupled between the second chemical container and the spray gun to control the flow of the second chemical to the spray gun. The second chemical control valve is electrically coupled to the second wireless system. In the first chemical mode, the second wireless system signals the first chemical control valve to open upon receiving a first chemical mode signal from the first wireless system in response to selecting the first chemical mode with the chemical user interface. In the second chemical mode, the second wireless system signals the second chemical control valve to open upon receiving a second chemical mode signal from the first wireless system in response to selecting the second chemical mode with the chemical user interface. In the no chemical mode, the first chemical control valve is closed and the second chemical control valve is closed.

Another embodiment relates to a method for remotely starting a pressure washer. The method includes operating a user interface of a spray gun to indicate a desire for providing pressurized fluid from the spray gun; and automatically starting a prime mover of the pressure washer in response to the operation of the user interface. Starting the prime mover causes the prime mover to drive a pump to provide pressurized fluid to the spray gun. The method further includes subsequently operating the user interface to indicate a desire to stop providing pressurized fluid from the spray gun, and automatically stopping the prime mover in response to the subsequent operation of the user interface. Stopping the prime mover causes the pump to stop providing pressurized fluid to the spray gun.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
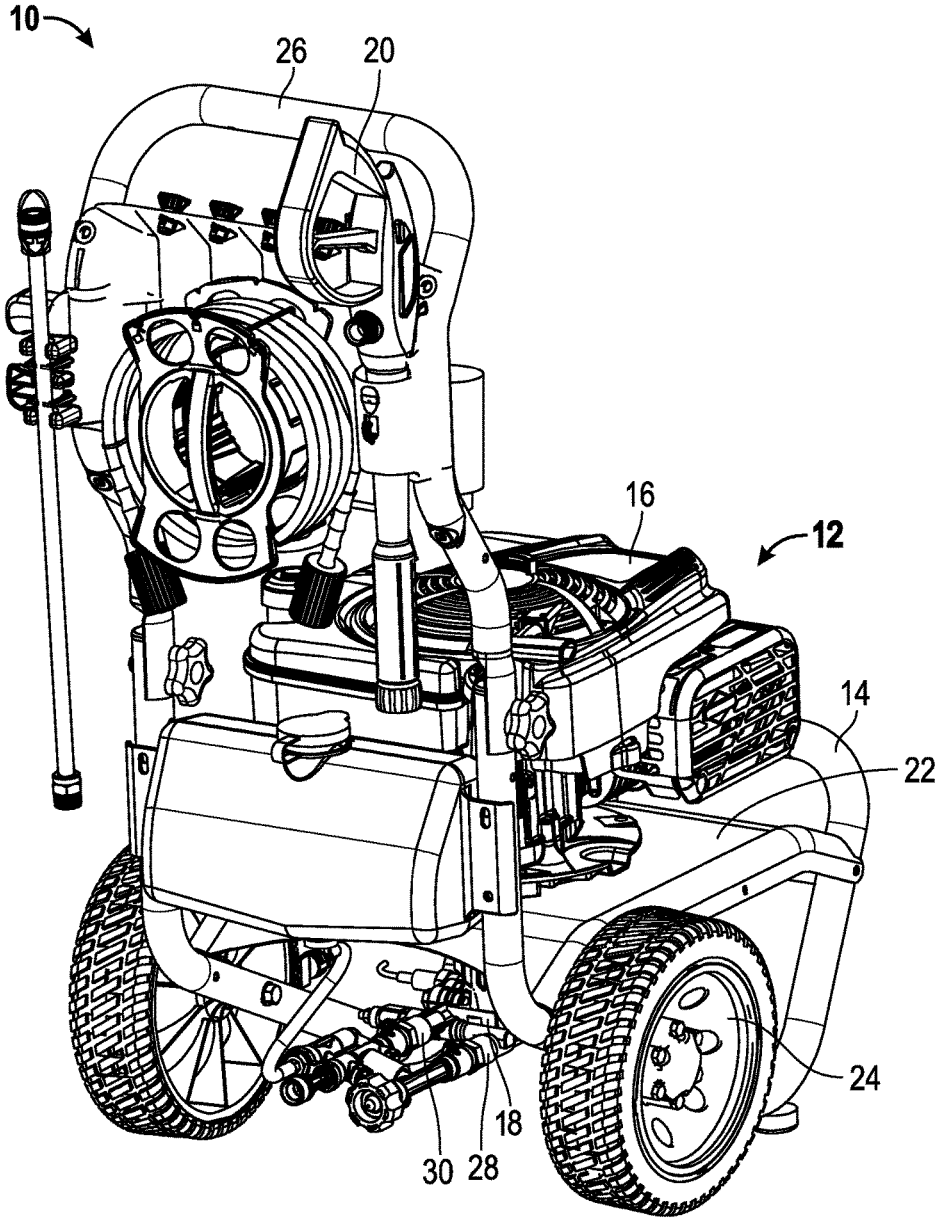
FIG. 1 is a rear perspective view of a pressure washer including multiple chemical tanks, according to an exemplary embodiment.

Referring to FIG. 1, a pressure washer 10 includes a base unit 12 with a frame 14 supporting a prime mover 16, such as an internal combustion engine or an electric motor, and a water pump 18 (e.g., positive displacement pump, piston water pump, axial cam pump). The pressure washer 10 further includes a spray gun 20 that is coupled to the water pump 18 with a delivery conduit 21 (e.g., a high-pressure hose). In other embodiments, an electric motor is used as the prime mover 16. In some embodiments, the prime mover 16 is fastened to the top of a base plate 22 of the frame 14 and the water pump 18 is mounted below the base plate 22 and connected to a power takeoff of the prime mover 16 via a hole through the base plate 22. In other embodiments, the water pump is directly coupled to and supported by the engine or prime mover. The water pump 18 is coupled (e.g., directly coupled, indirectly coupled by a transmission, belts, gears, or other drive system) to the prime mover 16 to be driven by the prime mover 16. In some embodiments, the pressure washer 10 is portable and includes wheels 24 and a handle 26. In other embodiments, the pressure washer 10 may be stationary. In other embodiments, the pressure washer 10 is mounted to a trailer or other vehicle. The water pump 18 includes a pump inlet 28 and a pump outlet 30. The pump inlet 28 is configured to be coupled to a supply conduit or hose, which is in turn connected to a fluid supply (e.g., a spigot connected to a municipal water supply or well). In some embodiments, the pump inlet 28 includes a low-pressure, garden-hose style fitting for coupling a garden hose to the pump inlet 28. The pump outlet 30 includes a high-pressure fitting (e.g., an M22 fitting) for coupling the pump outlet 30 to the delivery conduit 21 or other device including an appropriate high pressure fitting. As shown in FIG. 1, pressure washer 10 uses a vertical shaft engine. According to an alternative embodiment, the prime mover may be a horizontal shaft engine.

Figure 2:
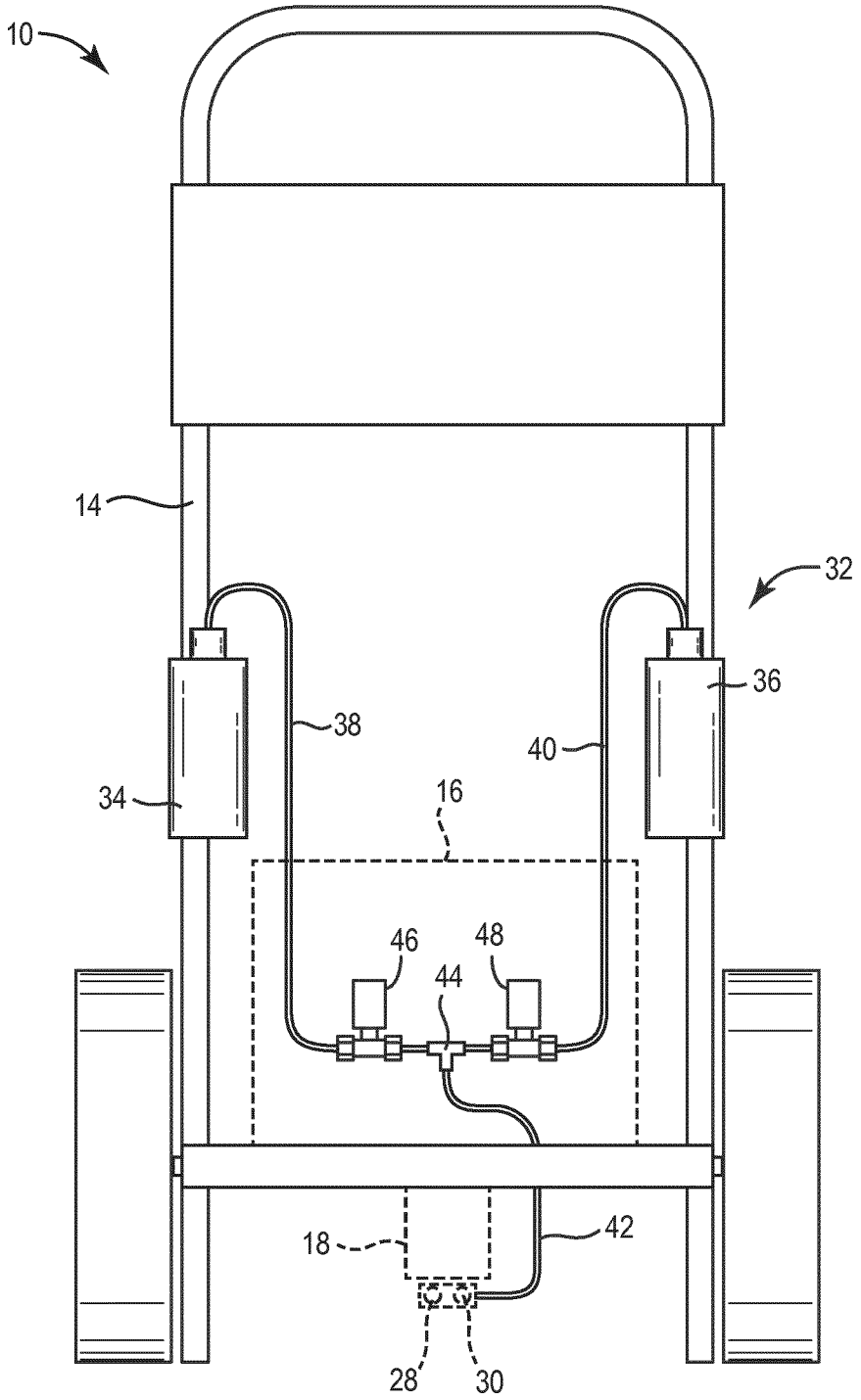
FIG. 2 is a schematic front view of the pressure washer of FIG. 1.

Referring to FIG. 2, the pressure washer 10 further includes a chemical supply system 32 that is configured to selectively introduce a liquid chemical into the water stream provided to the spray gun 20. The liquid chemical may be a detergent for cleaning various surfaces, a fertilizer for lawn care, a pesticide, an herbicide, etc. According to an exemplary embodiment, the chemical is provided in a container and the chemical supply system 32 includes multiple containers, shown in FIG. 2 as a first container 34 and a second container 36. The first container 34 and the second container 36 contain different chemicals. For example, the first container 34 may contain a detergent and the second container 36 may contain an herbicide. The chemical supply system 32 is able to switch the supply of chemicals between the first container 34 and the second container 36, allowing the pressure washer 10 to be used for multiple tasks without disposing of any unused chemical within a container and refilling a container with another chemical. According to an exemplary embodiment, the first container 34 and the second container 36 are mounted to the frame 14.

A first chemical flows out of the first container 34 through a first conduit 38. A second chemical flows out of the second container 36 through a second conduit 40. The first conduit 38 and the second conduit 40 and coupled to a third conduit 42 via a tee junction 44. The third conduit 42 is in fluid communication with the pump outlet 30, allowing the first chemical or the second chemical to be introduced into the water stream to the spray gun 20. The flow of the first chemical is controlled with a first valve 46 and the flow of the second chemical is controlled with a second valve 48. According to an exemplary embodiment, the first valve 46 and the second valve 48 are normally closed electronic solenoid valves controlled by a wireless system 50 (shown in FIG. 6). The wireless system 50 opens and closes the valves 46 and 48 in response to an input from the spray gun 20, allowing the user to transition between the two chemicals without having to be next to the base unit 12. In some embodiments, the valves 46 and 48 may be normally open and may be closed in response to an input from the spray gun 20, as described in more detail below.

Figure 3:
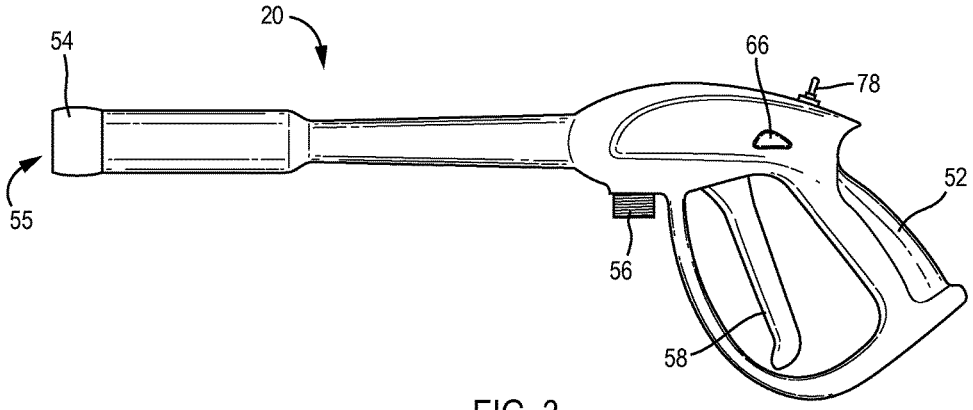
FIG. 3 is a side view of a spray gun for the pressure washer of FIG. 1, according to an exemplary embodiment.
Figure 4:
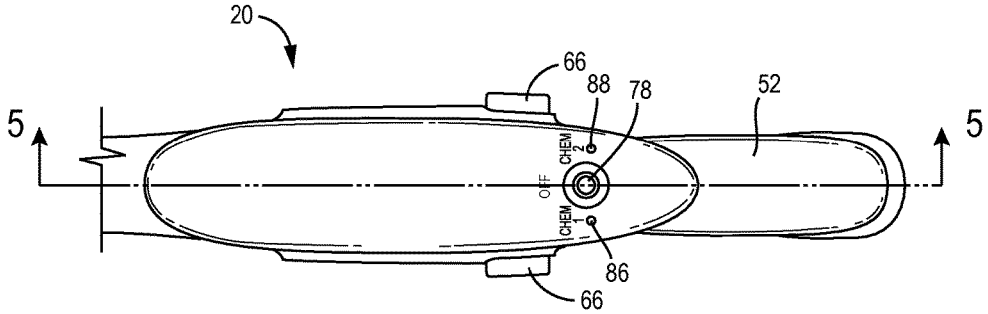
FIG. 4 is a top view of a portion of the pressure washer of FIG. 3.

Referring now to FIG. 3-4, the spray gun 20 is shown according to an exemplary embodiment to include a handle 52 and a nozzle 54. High pressure water is provided to the spray gun 20 from the pump outlet 30 through the delivery conduit 21, which is coupled to the spray gun 20 via an inlet 56. The inlet 56 may be a threaded fitting, such as a high-pressure fitting (e.g., an M22 fitting). The stream of water output from the nozzle 54 can be started or stopped by a user using a trigger 58. The spray gun 20 allows the user to manage the direction of the stream of water independent of the location and orientation of the base unit 12 and the duration of the stream of water. In some embodiments, the nozzle 54 may be a variable nozzle that is capable of producing various patterns, pressures, and flow rates for the stream of water (e.g., the nozzle 54 may include a rotatable head 55 with multiple openings). In some embodiments, the nozzle 54 may receive one of multiple spray nozzles, each of which provide a different pattern, pressure, flow rate, etc.

Figure 5:
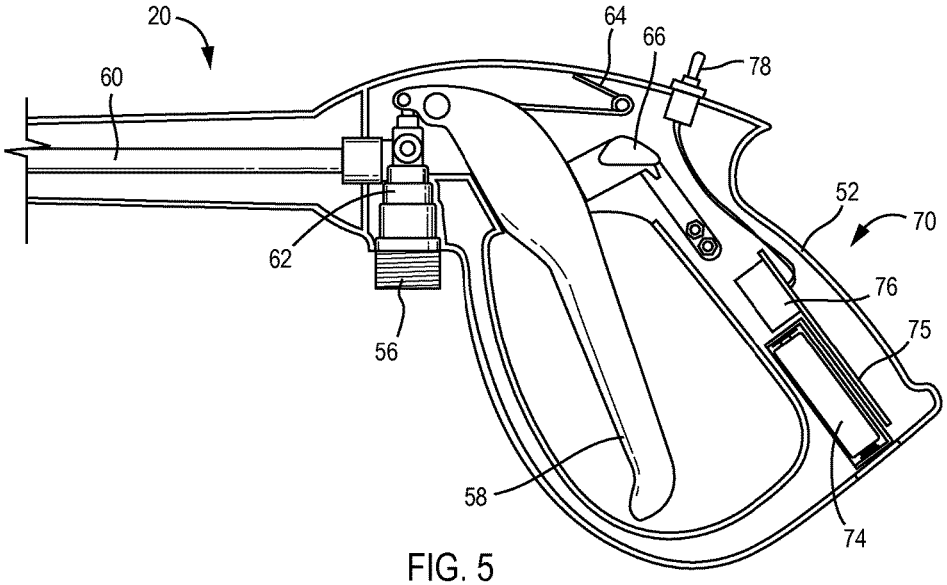
FIG. 5 is a cross-section view of the handle portion of the spray gun of FIG. 4, taken along line 5-5.

Referring now to FIG. 5, the internal components of the spray gun 20 are shown schematically according to an exemplary embodiment. The water passes from the inlet 56 to the nozzle 54 through an internal conduit 60. The passage of water is controlled by a flow-control valve 62 that is coupled to and controlled by the trigger 58 or other user input (e.g., trigger, button, switch, dial, touch screen, etc.). The flow-restriction valve 62 is configured to be opened when the user pulls the trigger 58 towards the handle 52, allowing the water to flow through the conduit 60 to be expelled through the nozzle 54, and closed when the trigger 58 is released. The trigger 58 may be biased towards the closed position by a biasing element, shown in FIG. 5 as a torsion spring 64. The spray gun 20 may further include a locking device to prevent the trigger 58 from being inadvertently pulled. According to an exemplary embodiment, the locking device is provided in the form of a locking switch 66. The locking switch 66 has a locked position in which it disposed along the path of the trigger 58. The locking switch 66 extends out of either side of the spray gun 20 proximate the handle 52. The user can push the locking switch 66 out of the locked position by depressing the switch 66 from either side (e.g., with the thumb), allowing the trigger 58 to be pulled. The ability for the locking switch 66 to be unlocked from either side allows the spray gun 20 to be used in either hand. The locking switch may be biased towards the locked position. The trigger 58 may be configured to engage the locking switch 66 in the unlocked position such that a user may keep the locking switch 66 in the unlocked position by keeping the trigger 58 pulled back, thereby reducing the strain of applying a continuous pressure on the locking switch 66. Releasing the trigger 58 may disengage it from the locking switch 66, allowing the locking switch 66 to return to the locked position and requiring the user to move the locking switch 66 back to the unlocked position to allow the trigger 58 to be pulled again.

Figure 6:
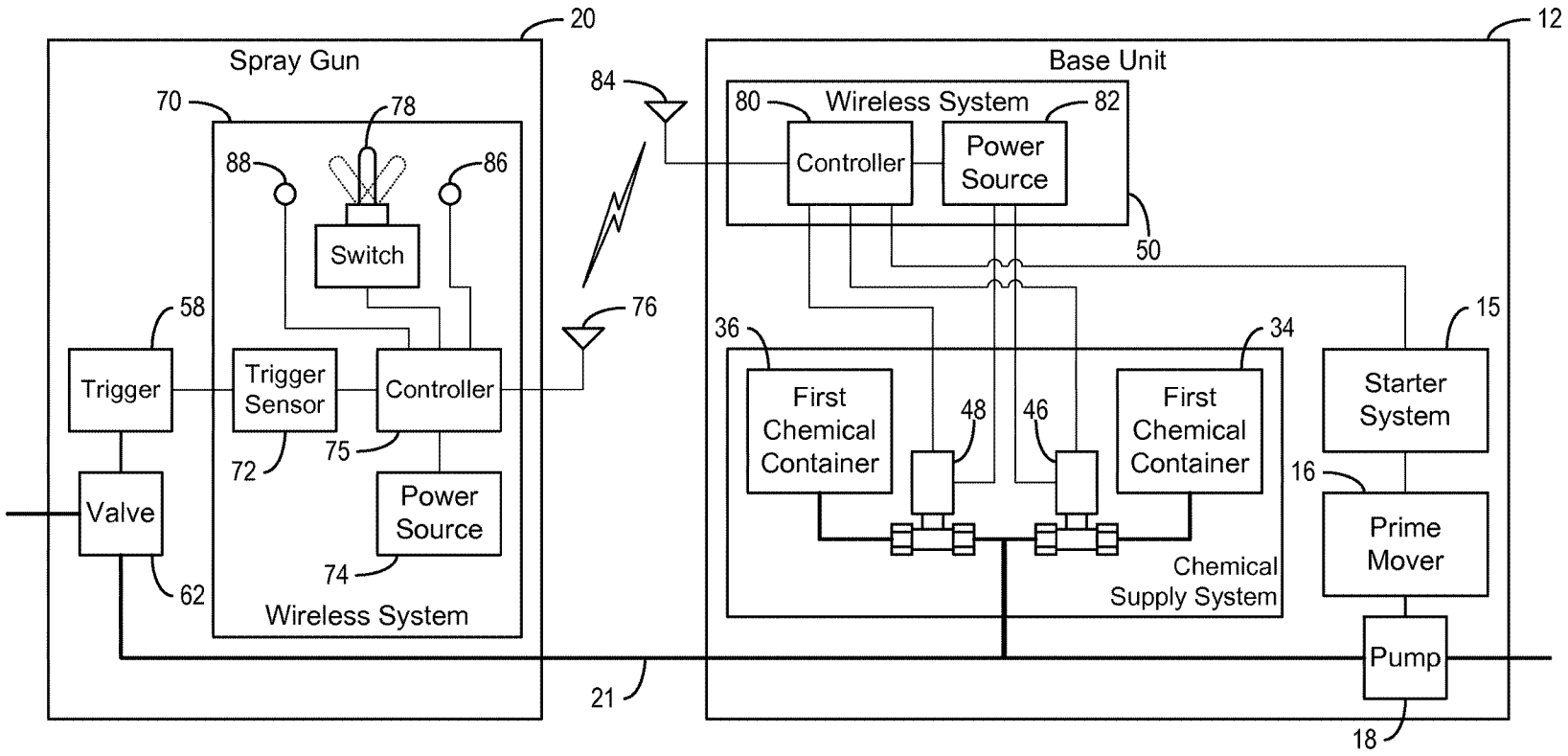
FIG. 6 is a block diagram of a control system for the pressure washer of FIG. 1, according to an exemplary embodiment.

Referring now to FIG. 6, a block diagram of the pressure washer system 10 is shown according to an exemplary embodiment. The spray gun 20 includes a wireless system 70 that allows the spray gun 20 to communicate with the wireless system 50 provided on the base unit 12, to control components of the pressure washer 10 such as the prime mover 16 or the chemical supply system 32. The wireless system 70 includes a trigger sensor 72, a power source 74, a controller 75 (e.g., circuit board, control circuitry, etc.), a transceiver 76 with which the wireless system 70 communicates with the wireless system 50. and a chemical selection switch 78. The wireless system 50 includes a controller 80 (e.g., circuit board, control circuitry, etc.), a power source 82, and a transceiver 84 with which the wireless system 50 communicates with the wireless system 70.

In some embodiments, the controllers 75 and 80 may each include a processor and a memory device. The processor can be implemented as a general purpose processor, an application specific integrated circuit (ASIC), one or more field programmable gate arrays (FPGAs), a group of processing components, or other suitable electronic processing components. The memory device (e.g., memory, memory unit, storage device, etc.) is one or more devices (e.g., RAM, ROM, Flash memory, hard disk storage, etc.) for storing data and/or computer code for completing or facilitating the various processes, layers and modules described in the present application. The memory device may be or include volatile memory or non-volatile memory. The memory device may include database components, object code components, script components, or any other type of information structure for supporting the various activities and information structures described in the present application. According to an exemplary embodiment, the memory device is communicably connected to the processor via the processing circuit and includes computer code for executing (e.g., by processing circuit and/or processor) one or more processes described herein.

In another exemplary embodiment, the controllers 75 or 80 may be implemented as non-programmable circuitry, one or more circuit boards, or one or more linear circuits. "Non-programmable circuitry" consists of analog or digital hard circuitry that does not utilize a microcontroller or software. It is believed that embodiments in which the controllers 75 or 80 are implemented as non-programmable circuitry including discrete components may be less expensive than embodiments implemented with microcontrollers or using software. Such non-programmable circuitry embodiments do not include a microcontroller. Non-programmable circuitry may include multiple discrete components that implement the various operations described herein.

According to an exemplary embodiment, the wireless system 70 of the spray gun 20 communicates with the wireless system 50 of the base unit 12 with low power, short range wireless RF communication. RF technology is relatively inexpensive compared to other wireless communication options (e.g., Bluetooth, WiFi, etc.). Unlike infrared technology, RF transceivers do not require line-of-sight and are omni-directional so that the spray gun 20 need not be pointed at the base unit 12 to establish communication.

The trigger sensor 72 may be a simple device, such as a switch that completes a circuit when the trigger 58 is pulled and/or when the locking switch 66 is moved from the locked position. When the trigger sensor 72 detects that the trigger 58 has been pulled, a signal is sent by the transceiver 76 to the transceiver 84 of the base unit wireless system 50. The signal instructs the controller 80 of the wireless system 50 to activate the starter system 15 to start the prime mover 16, powering the pump 18 to provide a pressurized water stream to the spray gun 20. The wireless system 70 therefore allows the user to easily start the pressure washer 10 from the spray gun 20 without having to be near the base unit 12.

In another embodiment, flow may be initiated by a signal from a valve position sensor monitoring the position of the flow control valve 62. When the valve position sensor detects that the flow control valve 62 has been opened by the trigger being pulled, a signal is sent by the transceiver 76 to the transceiver 84 of the base unit wireless system 50. The signal instructs the controller 80 of the wireless system 50 to activate the starter system 15 to start the prime mover 16, powering the pump 18 to provide a pressurized water stream to the spray gun 20.

The controller 80 monitors the starter system 15 and disengages the starter system 15 once it is determined that the prime mover 16 has been started. According to an exemplary embodiment, the controller 80 monitors the rotational speed of the prime mover, such as by monitoring the spark signal. Once the rotational speed reaches a predetermined threshold indicating the prime mover 16 has started, the controller 80 stops the starter system 15.

In one embodiment, the wireless system 70 may include a start delay. The start delay postpones the sending of a start signal to the prime mover 16 until the trigger 58 has been pulled for a predetermined period of time (e.g., 1 sec.). A user may therefore pull the trigger 58 either intentionally or unintentionally without causing the prime mover to stop and start repeatedly.

According to an exemplary embodiment, the wireless system 70 sends a continuous signal to the base unit 12 to keep the prime mover 16 running. Once the trigger 58 is released, the signal to the base unit 12 ceases and the prime mover 16 stops running. In one embodiment, the wireless system 70 may include a stop delay. The delay allows the trigger 58 to be released for a predetermined period of time (e.g., 5 seconds) before the prime mover 16 is turned off. A user may therefore release the trigger 58 either intentionally (e.g., to switch the spray gun between hands, to readjust the hand on the trigger 58, etc.) or unintentionally without causing the prime mover to stop and start repeatedly. In some embodiments, the duration of the stop delay may be adjustable by a user of the pressure washer 10 with a user input device (e.g., a dial, a switch, a button, a touchscreen, etc.).

As described above, a liquid chemical may be added to the water stream. According to an exemplary embodiment, the spray gun 20 includes a switch 78 coupled to the controller 75 allowing the user to wirelessly control the chemical supply system 32. As shown in FIG. 4, according to one exemplary embodiment the switch 78 is a three-position switch mounted to the spray gun 20 proximate the handle 26. The switch 78 is operable by the user to select a chemical from the chemical supply system 32 to be added to the water stream. The switch 78 has a first position (e.g., first chemical position, left position, etc.) in which the chemical supply system 32 adds a liquid chemical from the first chemical container 34 to the water stream, a second position (e.g., second chemical position, right position, etc.) in which the chemical supply system 32 adds a liquid chemical from the second chemical container 36 to the water stream, and a third position (e.g., middle position) in which no chemicals are added to the water stream by the chemical supply system 32. The spray gun 20 may include text labels, icons, or other indicia on the housing proximate the switch 78 to communicate the function of the switch 78 to the user. According to another exemplary embodiment, the switch 78 may be another type of switch, such as a dial (e.g., rotary switch), a series of push buttons, or a slide switch. The chemical supply system 32 may be capable of delivering chemicals from more than two containers and the switch may likewise be configured to allow the user to select from the more than two chemicals.

When the switch 78 is moved to the first position, a signal is sent from the transceiver 76 to the transceiver 84. The controller 80 receives the signal and powers the first solenoid valve 46, opening the valve 46 and allowing the first chemical to flow out of the first chemical container 34 to join the stream of water pumped from the base unit 12 to the spray gun 20 through the conduit 21. The controller 80 monitors the first solenoid valve 46 (e.g., monitors the voltage across the first solenoid valve) to confirm that the first solenoid valve 46 is activated and open. If the valve 46 is open, the controller 80 sends a signal to the controller 75 of the wireless system 70 directing the controller 75 to activate a visual indicator. According to an exemplary embodiment, the visual indicator is an LED 86 mounted proximate the switch 78 (e.g., proximate a label or indicia for the switch corresponding to the first chemical). The LED 86 lights up to provide a visual confirmation for the user that the first chemical is being added to the stream of water.

When the switch 78 is moved to the second position, a signal is sent from the transceiver 76 to the transceiver 84. The controller 80 receives the signal and powers the second solenoid valve 48, opening the valve 48 and allowing the second chemical to flow out of the second chemical container 36 to join the stream of water pumped from the base unit 12 to the spray gun 20 through the conduit 21. The controller 80 monitors the second solenoid valve 48 (e.g., monitors the voltage across the second solenoid valve) to confirm that the second solenoid valve 48 is activated and open. If the valve 48 is open, the controller 80 sends a signal to the controller 75 of the wireless system 70 directing the controller 75 to activate a visual indicator. According to an exemplary embodiment, the visual indicator is an LED 88 mounted proximate the switch 78 (e.g., proximate a label or indicia for the switch corresponding to the first chemical). The LED 86 lights up to provide a visual confirmation for the user that the second chemical is being added to the stream of water.

In another embodiment, the states of the first solenoid valve 46 and the second solenoid valve 48 may be determined by monitoring the physical positions of the first solenoid valve 46 and the second solenoid valve 48. The positions of the first solenoid valve 46 and the second solenoid valve 48 may be monitored, for example, with a device such as a limit switch, an optical switch, a magnetic switch, an encoder, etc.

In some embodiments, the chemical supply system 32 may include a delay when switching between chemicals. For example, the user may switch from the first chemical to the second chemical by providing a control signal from the spray gun, such as by moving the switch 78 from the first position to the second position. With the switch in the second position, the chemical supply system 32 may keep both the first solenoid valve 46 and the second solenoid valve 48 in the closed positions for a period of time to allow water to flush the first chemical from the various conduits before opening the second solenoid valve 48 to add the second chemical to the water stream.

According to another embodiment, the spray gun 20 may include additional controls to allow a user to further control the pressure washer 10 from the spray gun 20. For example, in another embodiment, the valves controlling the flow of chemicals into the stream of water may not be on/off valves but may be configured to variably adjust the flow of the chemicals, thereby adjusting the relative concentration of the chemical in the stream of water. The spray gun 20 may therefore include an input device such as a slider or a dial allowing the user to adjust the valves from a fully open position (e.g., a maximum concentration of a chemical in the stream of water) to a fully closed position (e.g., no chemical in the stream of water).

The power source 74 is a replaceable or rechargeable power source that provides electrical power to operate the transceiver 76, as well as electronic components on the spray gun 20, such as the indicator lights 86 and 88. According to an exemplary embodiment, the power source 74 is a pair of AA size batteries housed within the handle 26. In one embodiment, the batteries may be replaceable alkaline batteries and the spray gun 20 may include a removable door, allowing a user to access and replace the batteries. In another embodiment, the batteries may be rechargeable batteries (e.g., lithium-ion batteries, nickel-cadmium batteries, etc), and the spray gun 18 may include an external port coupled to the batteries. A user may recharge the batteries by plugging the port into another power source (e.g., an external charger).

The power source 82 provides power to the wireless system 50, such as the controller 80 and to related electronic components such as the solenoid valves 46 and 48. According to an exemplary embodiment, the power source 82 is an on-board battery, such as a common 12V lead-acid battery mounted on the frame 14. The power source may be configured to provide power to other components of the pressure washer 10, such as the starter system 15.

Figure 7:
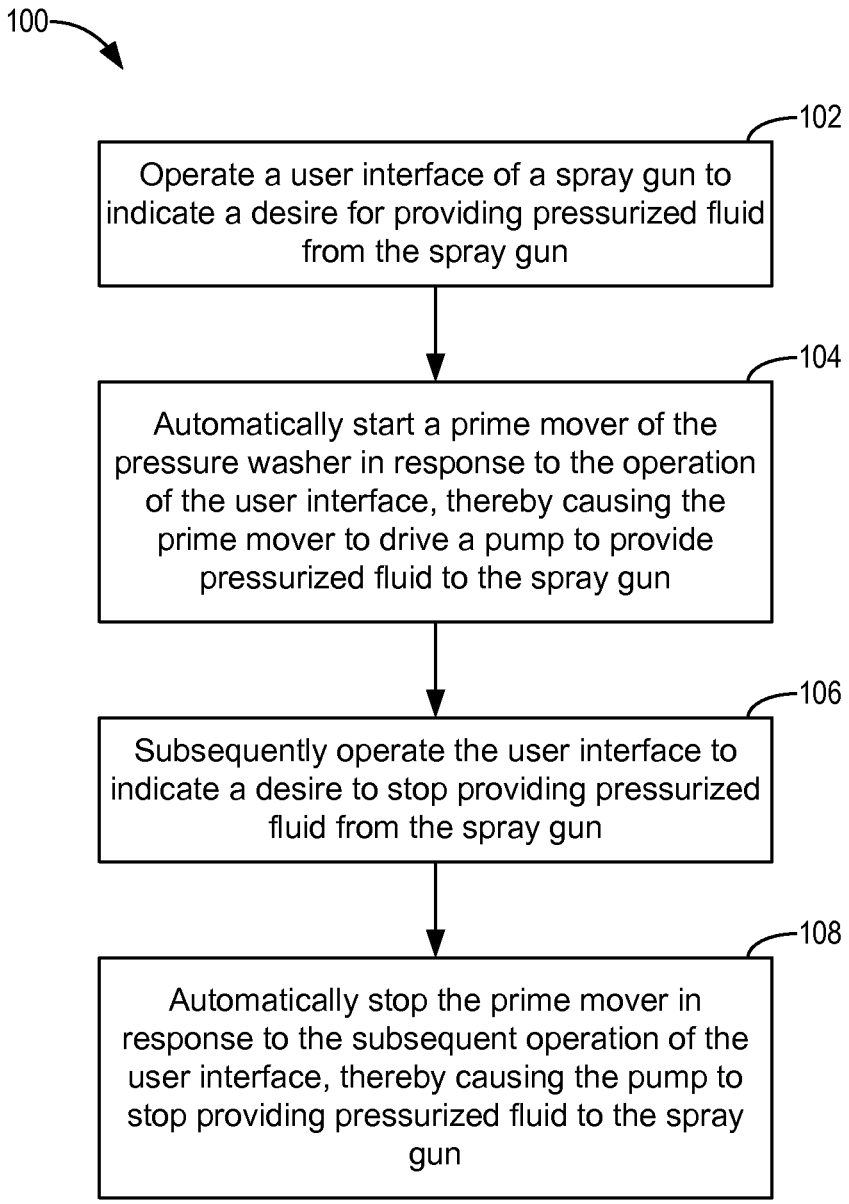
FIG. 7 is a flowchart of a method for controlling the pressure washer of FIG. 1, according to an exemplary embodiment.

Referring now to FIG. 7, a flowchart illustrates a method 100 for starting a pressure washer with wireless capabilities. The method includes operating a user interface of a spray gun to indicate a desire for providing pressurized fluid from the spray gun (step 102) and automatically starting a prime mover of the pressure washer in response to the operation of the user interface, thereby causing the prime mover to drive a pump to provide pressurized fluid to the spray gun (step 104). The method further includes subsequently operating the user interface to indicate a desire to stop providing pressurized fluid from the spray gun (step 106), and automatically stopping the prime mover in response to the subsequent operation of the user interface, thereby causing the pump to stop providing pressurized fluid to the spray gun (step 108).

As utilized herein, the terms "approximately," "about," "proximate," "substantially," and similar terms are intended to have a broad meaning in harmony with the common and accepted usage by those of ordinary skill in the art to which the subject matter of this disclosure pertains. These terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "exemplary" as used herein to describe various embodiments is intended to indicate that such embodiments are possible examples, representations, and/or illustrations of possible embodiments.

The terms "coupled," "connected," and the like as used herein mean the joining of two members directly or indirectly to one another. Such joining may be stationary (e.g., permanent) or movable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the accompanying drawings. The orientation of various elements may differ according to other exemplary embodiments, and that such variations are intended to be encompassed by the present disclosure.

The construction and arrangement of the pressure washer as shown in the various exemplary embodiments is illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A pressure washer, comprising:

a prime mover;

a pump driven by the prime mover;

a spray gun fluidly coupled to the pump, the spray gun including a flow-control valve movable between an open position and a closed position to control a fluid flow from the spray gun, a user interface for controlling the flow-control valve such that in a first state of the user interface, the flow-control valve is in the closed position, and in a second state of the user interface, the flow-control valve is in the open position, a sensor configured to detect the state of the user interface, a first wireless system electrically coupled to the sensor, and a power source configured to provide power to the first wireless system and the sensor;

a second wireless system electrically coupled to the prime mover;

a first chemical container fluidly coupled to the spray gun, the first chemical container configured to contain a first chemical;

a second chemical container fluidly coupled to the spray gun, the second chemical container configured to contain a second chemical;

a first chemical control valve fluidly coupled between the first chemical container and the spray gun to control the flow of the first chemical to the spray gun, the first chemical control valve electrically coupled to the second wireless system;

a second chemical control valve fluidly coupled between the second chemical container and the spray gun to control the flow of the second chemical to the spray gun, the second chemical control valve electrically coupled to the second wireless system;

a first position sensor configured to detect that the first chemical control valve is open, the first position sensor electrically coupled to the second wireless system; and a second position sensor configured to detect that the second chemical control valve is open, the second position sensor electrically coupled to the second wireless system;

wherein the second wireless system signals the prime mover to start, thereby driving the pump to provide fluid to the spray gun upon receiving a start signal from the first wireless system indicating that the sensor detects the user interface in the second state:

wherein the spray gun further includes a chemical user interface electrically coupled to the first wireless system, the chemical user interface configured to select between a first chemical mode, a second chemical mode, and a no chemical mode;

wherein in the first chemical mode, the second wireless system signals the first chemical control valve to open upon receiving a first chemical mode signal from the first wireless system in response to selecting the first chemical mode with the chemical user interface;

wherein in the second chemical mode, the second wireless system signals the second chemical control valve to open upon receiving a second chemical mode signal from the first wireless system in response to selecting the second chemical mode with the chemical user interface;

wherein in the no chemical mode, the first chemical control valve is closed and the second chemical control valve is closed wherein the spray gun further includes a first chemical mode indicator electrically coupled to the first wireless system and a second chemical mode indicator electrically coupled to the first wireless system;

wherein in the first chemical mode, the first wireless system signals the first chemical mode indicator to turn on upon receiving a first chemical mode indicator feedback signal from the second wireless system in response to the first position sensor detecting that the first chemical control valve is open; and wherein in the second chemical mode, the first wireless system signals the second chemical mode indicator to turn on upon receiving a second chemical mode indicator feedback signal from the second wireless system in response to the second position sensor detecting that the second chemical control valve is open.

2. The pressure washer of claim 1, wherein the second wireless system signals the prime mover to stop when the start signal from the first wireless system stops.

3. The pressure washer of claim 2, wherein the first wireless system continuously sends the start signal to second wireless system as long as the user interface is in the second state.

4. The pressure washer of claim 1, wherein the second wireless system signals the prime mover to stop when the start signal from the first wireless system stops for a predetermined amount of time.

5. The pressure washer of claim 4, further comprising:

a stop delay user input device for varying the predetermined amount of time.

6. The pressure washer of claim 1, wherein the first position sensor and the second position sensor each comprises a voltage sensor.

7. The pressure washer of claim 1, further comprising:

a frame supporting the prime mover, the pump, the first chemical container, and the second chemical container.

8. The pressure washer of claim 1, wherein the spray gun further comprises a lock that prevents the user interface from transitioning from the first state to the second state unless the lock is disengaged.

9. A pressure washer, comprising:

a prime mover;

a pump driven by the prime mover;

a spray gun fluidly coupled to the pump, the spray gun including a first wireless system and a chemical user interface electrically coupled to the first wireless system, the chemical user interface configured to select between a first chemical mode, a second chemical mode, and a no chemical mode;

a second wireless system;

a first chemical container fluidly coupled to the spray gun, the first chemical container configured to contain a first chemical;

a second chemical container fluidly coupled to the spray gun, the second chemical container configured to contain a second chemical;

a first chemical control valve fluidly coupled between the first chemical container and the spray gun to control the flow of the first chemical to the spray gun, the first chemical control valve electrically coupled to the second wireless system; and a second chemical control valve fluidly coupled between the second chemical container and the spray gun to control the flow of the second chemical to the spray gun, the second chemical control valve electrically coupled to the second wireless system;

a first position sensor configured to detect that the first chemical control valve is open, the first position sensor electrically coupled to the second wireless system;

a second position sensor configured to detect that the second chemical control valve is open, the second position sensor electrically coupled to the second wireless system;

wherein the spray gun further includes a first chemical mode indicator electrically coupled to the first wireless system and a second chemical mode indicator electrically coupled to the first wireless system;

wherein in the first chemical mode, the first wireless system signals the first chemical mode indicator to turn on upon receiving a first chemical mode indicator feedback signal from the second wireless system in response to the first position sensor detecting that the first chemical control valve is open and the second wireless system signals the first chemical control valve to open upon receiving a first chemical mode signal from the first wireless system in response to selecting the first chemical mode with the chemical user interface;

wherein in the second chemical mode, the first wireless system signals the second chemical mode indicator to turn on upon receiving a second chemical mode indicator feedback signal from the second wireless system in response to the second position sensor detecting that the second chemical control valve is open and the second wireless system signals the second chemical control valve to open upon receiving a second chemical mode signal from the first wireless system in response to selecting the second chemical mode with the chemical user interface; and wherein in the no chemical mode, the first chemical control valve is closed and the second chemical control valve is closed.

10. The pressure washer of claim 9, wherein the first position sensor and the second position sensor each comprises a voltage sensor.

11. The pressure washer of claim 9, further comprising:

a frame supporting the prime mover, the pump, the first chemical container, and the second chemical container.

12. The pressure washer of claim 1, wherein the user interface comprises a trigger, wherein the sensor comprises a switch that completes a circuit when the trigger is pulled.

13. The pressure washer of claim 1, wherein the user interface comprises a trigger further comprising a locking switch configured to lock the trigger, the locking switch movable between a locked position and an unlocked position, wherein the sensor comprises a switch that completes a circuit when the locking switch is moved from the locked position.

14. The pressure washer of claim 9, wherein when switching between the first chemical mode and the second chemical mode, the second wireless system delays signaling the second chemical control valve to open upon receiving the second chemical mode signal from the first wireless system in response to selecting the second chemical mode with the chemical user interface.

15. The pressure washer of claim 14, wherein during the delay, the first chemical mode indicator is off and the second chemical mode indicator is off.

* * * * *